US010315433B2

(12) United States Patent
Matsuo et al.

(10) Patent No.: US 10,315,433 B2
(45) Date of Patent: Jun. 11, 2019

(54) INKJET HEAD AND INKJET RECORDING DEVICE

(71) Applicant: Konica Minolta, Inc., Chiyoda-ku, Tokyo (JP)

(72) Inventors: Takashi Matsuo, Suita (JP); Hideyuki Kobayashi, Hino (JP); Kusunoki Higashino, Musashino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/544,207

(22) PCT Filed: Jan. 15, 2016

(86) PCT No.: PCT/JP2016/051161

§ 371 (c)(1),
(2) Date: Jul. 17, 2017

(87) PCT Pub. No.: WO2016/114396

PCT Pub. Date: Jul. 21, 2016

(65) Prior Publication Data

US 2018/0264837 A1 Sep. 20, 2018

(30) Foreign Application Priority Data

Jan. 16, 2015 (JP) ..... 2015-006633

(51) Int. Cl.
*B41J 2/19* (2006.01)
*B41J 2/14* (2006.01)
(Continued)

(52) U.S. Cl.
CPC . *B41J 2/19* (2013.01); *B41J 2/14* (2013.01); *B41J 2/14233* (2013.01); *B41J 2/16* (2013.01);
(Continued)

(58) Field of Classification Search
CPC . B41J 2/19; B41J 2/185; B41J 2/14233; B41J 2/16; B41J 2002/12; B41J 2002/14403; B41J 2002/14419
See application file for complete search history.

(56) References Cited

U.S. PATENT DOCUMENTS

2011/0148988 A1* 6/2011 Hoisington ..... B41J 2/14233 347/54
2014/0285576 A1* 9/2014 Rivas ..... B41J 2/155 347/41

FOREIGN PATENT DOCUMENTS

JP 06340066 A 12/1994
JP 2005119287 A 5/2005
(Continued)

OTHER PUBLICATIONS

International Search Report corresponding to Application No. PCT/JP2016/051161; dated Apr. 12, 2016.
(Continued)

*Primary Examiner* — Sharon A. Polk
(74) *Attorney, Agent, or Firm* — Cantor Colburn LLP

(57) ABSTRACT

An embodiment of an inkjet may include a plurality of nozzles to eject ink, a pressure chamber individually communicated with each nozzle and filled with ink, a pressure generator to eject ink by applying pressure to the pressure chamber, an inlet including a narrow portion with a flow path narrower than the pressure chamber and structured to supply ink to the pressure chamber, and a circulation flow path structured to discharge ink in the pressure chamber from near the nozzle. Viscosity resistance of the circulation flow path may be smaller than viscosity resistance of the nozzle, and impedance of the circulation flow path may be equal to or more than 0.5 times of the impedance of the inlet.

14 Claims, 7 Drawing Sheets

(51) Int. Cl.

| | |
|---|---|
| ***B41J 2/16*** | (2006.01) |
| ***B41J 2/18*** | (2006.01) |
| ***B41J 2/185*** | (2006.01) |

(52) U.S. Cl.

CPC ..... *B41J 2/18* (2013.01); *B41J 2/185* (2013.01); *B41J 2002/14403* (2013.01); *B41J 2002/14419* (2013.01); *B41J 2202/12* (2013.01)

(56) References Cited

FOREIGN PATENT DOCUMENTS

| | | | |
|---|---|---|---|
| JP | 2011079251 | A | 4/2011 |
| JP | 2012011653 | A | 1/2012 |
| JP | 2012158086 | A | 8/2012 |
| JP | 5385975 | B2 | 1/2014 |
| JP | 2014054844 | A | 3/2014 |
| WO | 2009143362 | A1 | 11/2009 |

OTHER PUBLICATIONS

PCT International Preliminary Report on Patentability with Written Opinion of the International Searching Authority for corresponding PCT/JP20163/051161; dated Jul. 18, 2017.

Extended European Search Report corresponding to Application No. 16737467.7-1701/3246165 PCT/JP2016051161; dated Dec. 7, 2017.

SIPO Office Action corresponding to CN Application No. 201680005531.7; dated Apr. 2, 2018.

* cited by examiner

INKJET HEAD AND INKJET RECORDING DEVICE

CROSS REFERENCE TO PRIOR APPLICATIONS

This is the U.S. national stage of application No. PCT/JP2016/051161, filed Jan. 15, 2016. Priority under 35 U.S.C. § 119(a) and 35 U.S.C. § 365(b) is claimed from Japanese Application No. 2015-006633, filed Jan. 16, 2015, the disclosures of which are also incorporated herein by reference.

TECHNOLOGICAL FIELD

The present invention relates to an inkjet head and an inkjet recording device.

BACKGROUND ART

Conventionally, there is a known inkjet recording device which ejects drops of liquid ink from a plurality of nozzles provided in an inkjet head to form an image on a recording medium.

In conventional inkjet heads, there are problems such as nozzles clogging, failure of ejecting, etc. due to air bubbles caused in the inkjet head or foreign substances being mixed in the inkjet head.

Depending on the type of ink, if the inkjet head is not used for a long period of time, the ink viscosity near the nozzle increases due to the ink particles settling, and it becomes difficult for the ink to be ejected stably.

In view of the above, there is an inkjet recording device which is provided with an ink circulation flow path in the head chip of the inkjet head so that the air bubbles, etc. in the head can flow to the circulation flow path with the ink (for example, patent documents 1 and 2).

PRIOR ART DOCUMENT

Patent Document

Patent Document 1: Japanese Patent No. 5385975

Patent Document 2: Japanese Patent Application Laid-Open Publication No. 2005-119287

SUMMARY

Problems to be Solved by the Invention

However, the circulation flow path as described in patent document 1 is formed so that the impedance of the circulation flow path is two to ten times higher than the impedance of the nozzle. The ink can be circulated at an ink circulation speed of about 1/100 compared to the maximum ejecting point (circulation amount 1500 (pL/s) for ejecting amount 150000 (pL/s)). However, such flow speed is too slow, and it may become difficult to effectively discharge the air bubbles, foreign substances, and the like.

The circulation flow path as described in patent document 2 is provided with a valve which opens and closes with air pressure. When printing is not performed, the valve is opened to apply pressure to the supply flow path and to reduce the pressure in the circulation flow path. With this, the air bubbles in the pressure chamber can be effectively discharged to the circulation flow path. However, the valve needs to be closed during printing (ink ejecting) and the ink cannot be circulated. Therefore, the air bubbles which suddenly occur while the ink is ejected cannot be discharged.

Further, when a circulation flow path is made in the channel in a conventional method using a Helmholtz resonance method (vent method or push method), the pressure escapes to the circulation flow path. Therefore, pressure efficiency decreases and the ejecting performance decreases.

In order to prevent the decrease of the ejecting performance, the circulation flow path may be made thinner to prevent the pressure from escaping to the circulation flow path. However, if the circulation flow path is made thinner, the circulation speed decreases. Therefore, it becomes difficult to effectively discharge the air bubbles, foreign substances, etc.

Alternatively, for example, the pressure of the circulation flow path can be raised using a pump, etc. and the circulation speed can be accelerated without changing the circulation flow path. However, such measures become a burden to the device. Moreover, there is a possibility that the meniscus of the nozzle breaks and the ink may leak from the nozzle.

The present invention is conceived in view of the above problems, and provides an inkjet head and an inkjet head recording device in which the reduction of ejecting properties of ink is suppressed to a minimum by providing a circulation flow path and which can effectively discharge air bubbles, etc. near the nozzle without providing a burden on the apparatus.

Means for Solving the Problem

To achieve at least one of the above-mentioned objects, according to an aspect of the present invention, an inkjet head reflecting one aspect of the present invention includes, a plurality of nozzles which eject ink; a pressure chamber which is individually communicated with each nozzle and which is filled with ink inside; a pressure generator which is a driving source to eject ink by applying pressure to the pressure chamber; an inlet which includes a narrow portion with a flow path narrower than the pressure chamber and which supplies ink to the pressure chamber; and a circulation flow path which is able to discharge ink in the pressure chamber from near the nozzle, wherein, viscosity resistance of the circulation flow path is smaller than viscosity resistance of the nozzle, and impedance of the circulation flow path is equal to or more than 0.5 times of impedance of the inlet.

BRIEF DESCRIPTION OF THE DRAWINGS

The advantages and features provided by one or more embodiments of the invention will become more fully understood from the detailed description given herein below and the appended drawings which are given by way of illustration only, and thus are not intended as a definition of the limits of the present invention.

EMBODIMENT FOR CARRYING OUT THE INVENTION

Figure 1:
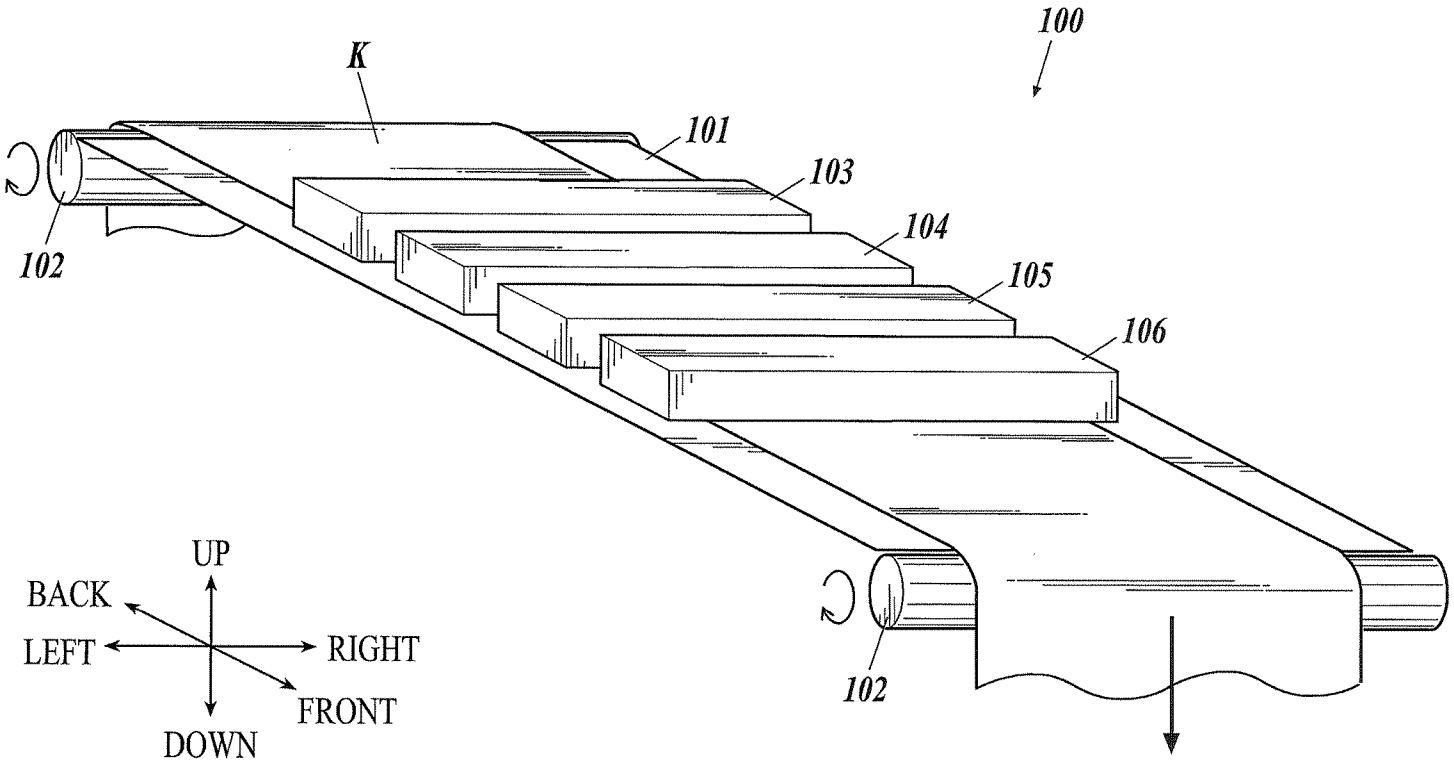
FIG. 1 is a perspective diagram showing a schematic configuration of an inkjet recording device.

Hereinafter, one or more embodiments of the present invention will be described with reference to the drawings. However, the scope of the invention is not limited to the disclosed embodiments.

A preferable embodiment of the present invention is described with reference to the drawings. The scope of the present invention is not limited to the illustrated examples. In the description below, the same reference numerals are applied to the same functions and configurations, and the description is omitted.

According to the description below, the embodiment described uses a one pass drawing method which draws by only conveying the recording medium using the line head. Alternatively, other drawing methods can be suitably applied, for example, a drawing method using a scanning method or a drum method can be applied.

According to the description below, a conveying direction of a recording medium K is a front and back direction, a direction orthogonal to the conveying direction on a conveying surface of the recording medium K is to be a left and right direction, and a direction perpendicular to the front and back direction and the left and right direction is to be an up and down direction.

Although embodiments of the present invention have been described and illustrated in detail, it is clearly understood that the same is by way of illustration and example only and not limitation, the scope of the present invention should be interpreted by terms of the appended claims.

[Overview of Inkjet Recording Device]

Figure 7:
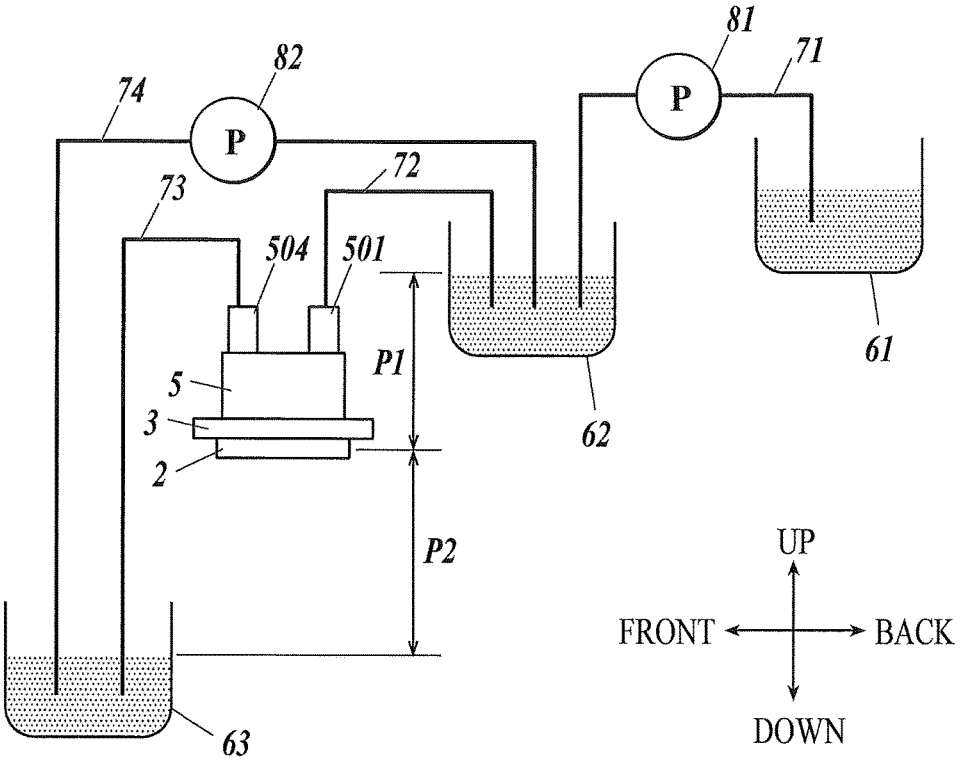
FIG. 7. is a schematic diagram describing a configuration of an ink circulation mechanism.

An inkjet recording device 100 includes a platen 101, conveying rollers 102, line heads 103, 104, 105, and 106, an ink circulation mechanism and the like (see FIG. 1 and FIG. 7).

The platen 101 supports the recording medium K with the upper surface, and when the conveying roller 102 is driven, the recording medium K is conveyed in the conveying direction (front and back direction).

The line heads 103, 104, 105, and 106 are provided aligned in a width direction (left and right direction) perpendicular to the conveying direction from an upstream side of the conveying direction (front and back direction) of the recording medium K to the downstream side. At least one later-described inkjet head 1 is provided inside the line heads 103, 104, 105, and 106, and ejects ink with colors such as cyan (C), magenta (M), yellow (Y), and black (K) to the recording medium K.

An ink circulation mechanism is described later (see FIG. 7).

[Overview of Configuration of Inkjet Head]

Figure 2:
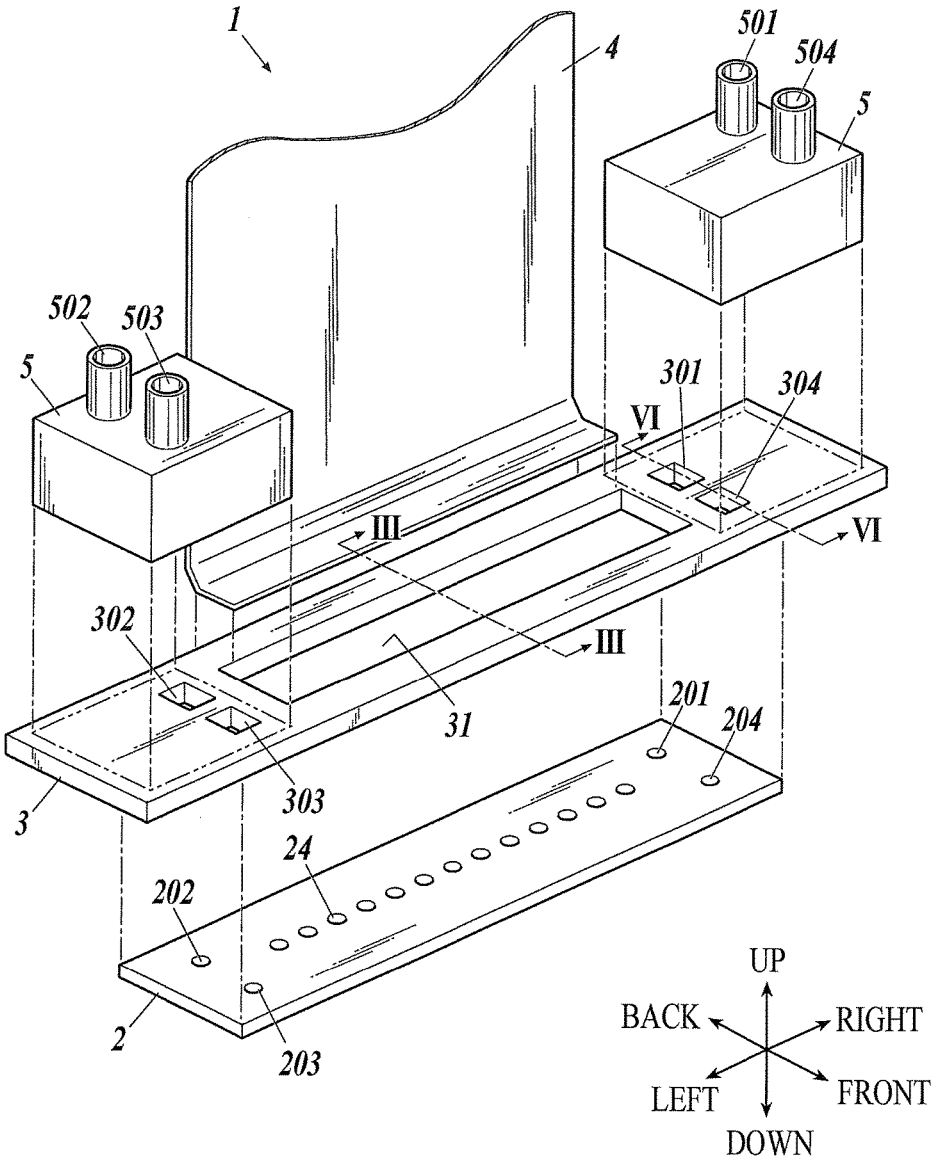
FIG. 2 is an exploded perspective diagram of an inkjet head.
Figure 3:
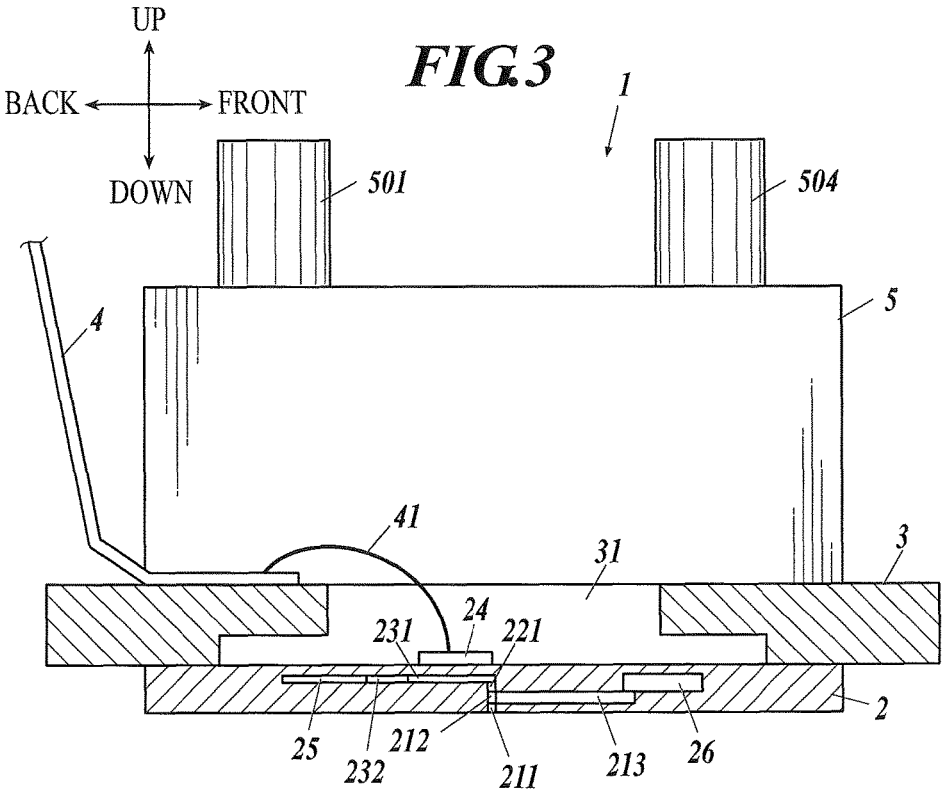
FIG. 3 is a cross-sectional diagram dividing a portion along line (III)-(III) in FIG. 2.

An inkjet head 1 includes a head chip 2, a holding plate 3, a connecting member 4, an ink flow path member 5, and the like (see FIG. 2 and FIG. 3).

A head chip 2 is a plurality of layered substrates, and a nozzle 211 to eject ink is provided in the most bottom layer. The upper surface of the head chip 2 is provided with a piezoelectric element 24 as a pressure generating unit. The piezoelectric element 24 is displaced, pressure is applied to the ink filled in a pressure chamber 231 inside the head chip 2, and the ink liquid drops are ejected from the nozzle 211.

The holding plate 3 is attached to the upper surface of the head chip 2 using an adhesive to maintain strength of the head chip 2. The holding plate 3 includes an opening 31 in the center so that the piezoelectric element 24 in the upper surface of the head chip 2 is stored inside the opening 31.

The connecting member 4 includes lines such as FPC. The width direction of the connecting member 4 is connected to a portion near the back side of the upper surface of the holding plate 3 along the left and right direction of the holding plate 3. The connecting member 4 is electrically connected to the piezoelectric element 24 through a bonding wire 41 passing through the opening 31 provided in the center of the holding plate 3. The connecting member 4 is connected to the driving unit (not illustrated) and electricity can be provided from the driving unit to the piezoelectric element 24 through the connecting member 4 and the bonding wire 41.

One ink flow path member 5 is attached to each edge of the upper surface of the holding plate 3 in the left and right direction. Each ink flow path member 5 is provided with one ink supplying flow path 501 and 502 used to supply the ink to the inside of the head chip 2 and one ink circulation flow path 503 and 504 used to discharge ink from inside the head chip 2.

The head chip 2, the holding plate 3, and the ink flow path member 5 are described in detail below.

Figure 4:
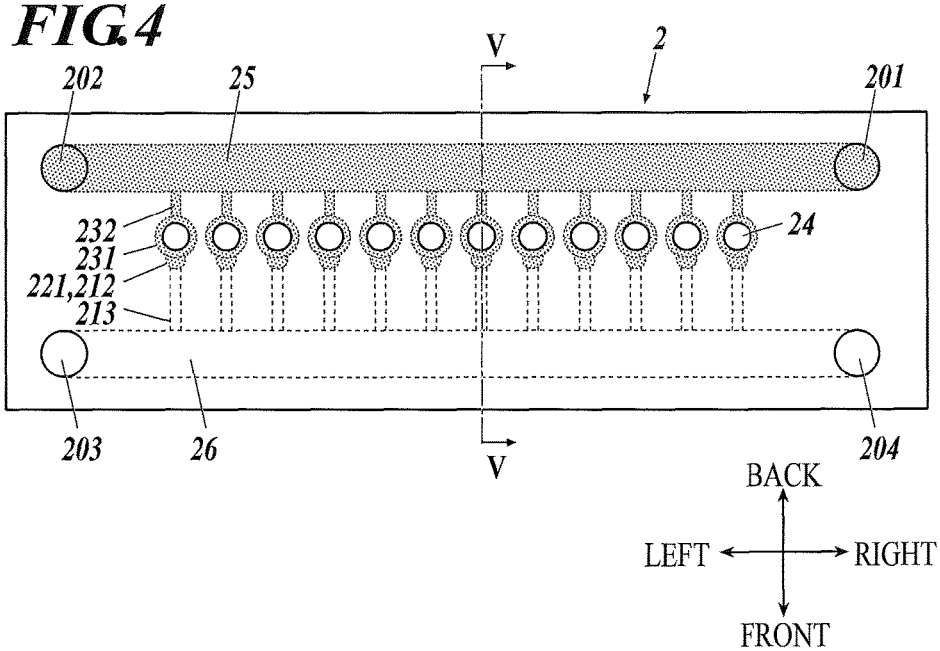
FIG. 4 is a planar diagram of a head chip.

For the purpose of description, the structure inside the head chip 2 in FIG. 4 is shown with a broken line. The ink flow path from a common supply flow path 25 to a communicating hole (intermediate communicating path) 221, . . . and the like is shown with dots.

[Head Chip]

The upper surface of the head chip 2 is provided with piezoelectric elements 24 provided aligned in one line along the left and right direction, ink supply openings 201 and 202 to supply ink inside the head chip 2 from the ink flow path member 5, ink circulation openings 203 and 204 to discharge ink to the ink flow path member 5 from inside the head chip 2 (see FIG. 4, etc.), and the like.

In the embodiment below, a circulation flow path 213 is formed in a nozzle plate 21. The circulation flow path 213 is to be positioned to the nozzle side than a body plate 23 in which the pressure chamber 231 is formed and alternatively, for example, the circulation flow path 213 can be provided in an intermediate plate 22. Therefore, near the nozzle means toward the nozzle side than a body plate 23 in which the pressure chamber 231 is formed. As described above, the problem of ejecting trouble due to air bubbles and foreign substances can be suppressed by providing the circulation flow path 213 near the nozzle but from the viewpoint of removing the air bubbles and the foreign substances nearer to the position of the nozzle 211 which more easily leads to ejecting trouble, preferably, the circulation flow path 213 is provided in the nozzle plate 21. Therefore, in the description below, providing the circulation flow path 213 in the nozzle plate 21 is described in detail.

Figure 5:
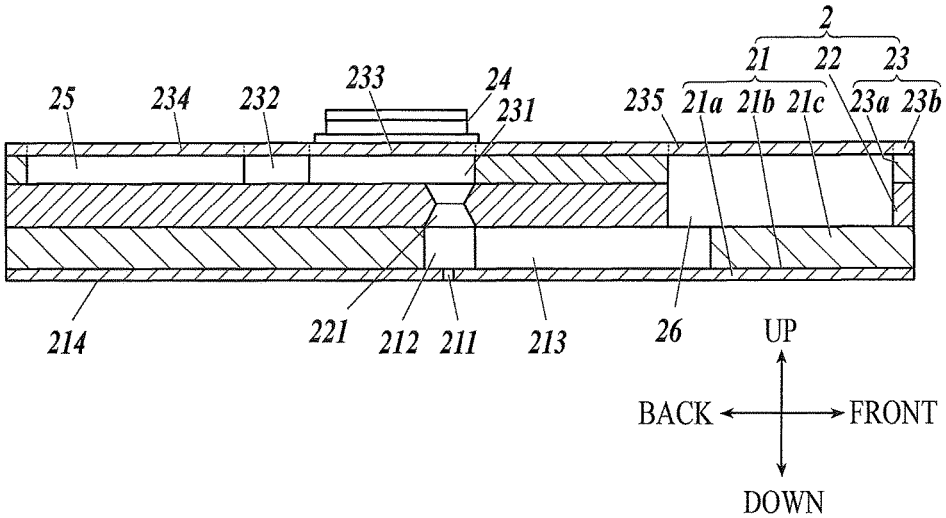
FIG. 5 is a cross-sectional diagram dividing a portion along line (V)-(V) in FIG. 4.

In the head chip 2, the following three substrates are layered as one from the bottom in the order of a nozzle plate 21, an intermediate plate 22, and a body plate 23 (FIG. 5).

The nozzle plate 21 is a substrate positioned in the lowest layer of the head chip 2, and for example, includes a SOI wafer including the following three layers, a nozzle layer 21*a*, a binding layer 21*b*, and a nozzle supporting layer 21*c*.

The nozzle layer 21*a* is a layer in which the nozzle 211 to eject the ink liquid drops is formed, and includes a Si substrate with a thickness such as 10 to 20 μm. An ink repelling layer (not illustrated) is formed in the nozzle surface 214 on the bottom surface of the nozzle layer 21*a*.

For example, the binding layer 21*b* includes a $SiO_2$ substrate with a thickness such as 0.3 to 1.0 μm.

The nozzle supporting layer 21*c* includes a Si substrate with a thickness such as 100 to 300 μm formed with a large size portion (nozzle communicating path) 212 with a diameter larger than the nozzle 211 to communicate with the nozzle 211, and the circulation flow path 213 to communicate with the large size portion 212 and used to circulate the ink.

Here, since the nozzle layer 21*a* and the nozzle supporting layer 21*c* each include the Si substrate, the nozzle layer 21*a* and the nozzle supporting layer 21*c* can be easily processed by dry etching or wet etching. Moreover, since the binding layer 21*b* includes the $SiO_2$ substrate which is thinner and has a much lower etching rate than the Si substrate, when the nozzle layer 21*a* and the nozzle supporting layer 21*c* are processed toward the binding layer 21*b*, even if there is a variation in the processing of the nozzle layer 21*a* and the nozzle supporting layer 21*c*, the processing can be controlled with the binding layer 21*b*.

Since the circulation flow path 213 is formed with a space facing the binding layer 21*b*, the circulation flow path 213 is made with fine accuracy. Alternatively, the circulation flow path 213 can be formed with a space facing the nozzle layer 21*a* by removing the binding layer 21*b* by the wet etching process using the buffered hydrofluoric acid (BHF), etc. after forming the space facing the binding layer 21*b*.

For example, the intermediate plate 22 includes, for example, a glass substrate which is about 100 to 300 μm. A communicating hole (intermediate communicating path) 221 which is to be an ink flow path when the ink is ejected is formed in a position corresponding to the large size portion 212 of the nozzle plate 21 so as to penetrate the intermediate plate 22.

The communicating hole 221 adjusts the shape of the ink flow path such as forming a shape to reduce the diameter of the ink passing flow path and adjusts movement energy applied to the ink when the ink is omitted.

Preferably, borosilicate glass (for example, Tempax glass) is used as the glass substrate of the intermediate plate 22.

The body plate 23 includes a pressure chamber layer 23*a* and a vibrating layer 23*b*.

The pressure chamber layer 23*a* includes, for example, a Si substrate which is about 100 to 300 μm. The pressure chamber layer 23*a* is formed with a plurality of pressure chambers 231 which are a substantial circle shape in a planar view and communicate with the communicating hole 221 of the intermediate plate 22, a common supplying flow path 25 which commonly supplies ink to the plurality of pressure chambers 231, and an inlet 232 which individually communicates the common supply flow path 25 with each pressure chamber 231 to supply the ink in the common supply flow path to the pressure chamber 231. The inlet 232 includes a narrow portion which is a flow path narrower than the pressure chamber 231, and it becomes difficult for the pressure applied to the pressure chamber 231 to escape from the inlet 232 side. The narrow portion is to have a flow path narrower than the pressure chamber 231 and the shape can be suitably changed.

The vibrating layer 23*b* is, for example, a thin Si substrate which is about 20 to 30 μm and can be elastically deformed. The vibrating layer 23*b* is layered on the upper surface of the pressure chamber layer 23*a*. In the vibrating layer 23*b*, the upper surface of the pressure chamber 231 functions as a vibrating plate 233. The vibrating plate 233 vibrates according to the operation of the piezoelectric elements 24 provided on the upper surface of the vibrating plate 233. With this, pressure can be applied to the ink in the pressure chamber 231.

A common circulation flow path 26 is provided in the intermediate plate 22 and the pressure chamber layer 23*a*. The common circulation flow path 26 is where the ink flowing from the plurality of circulation flow paths 213 formed in the nozzle supporting layer 21*c* join.

The vibrating layer 23*b* includes a damper 234 formed on an upper surface of the common supply flow path 25, and a damper 235 formed on the upper surface of the common circulation flow path 26. The dampers 234 and 235 are able to slightly deform flexibly when, for example, pressure is applied at once to the pressure chamber 231 and the ink flows at once to the common circulation flow path 26. With this, it is possible to prevent drastic change of pressure in the ink flow path.

Next, the ink circulation path is described. The ink is supplied from the ink supply openings 201 and 202 to the common supply flow path 25. Next, the ink separates from the common supply flow path 25 and flows to each nozzle 211, . . . , corresponding inlet 232, . . . , pressure chamber 231, . . . , communicating hole 221, . . . , large size portion 212, . . . , and circulation flow path 213, . . . Next, the ink from each circulation flow path 213, . . . meet at the common circulation flow path 26, the ink is discharged from the ink circulation openings 203 and 204, and the ink passes the ink circulation flow path 504 to return to a circulation sub-tank 63 (see FIG. 4, FIG. 5, and FIG. 7).

[Holding Plate]

The holding plate 3 is attached to the upper surface of the head chip 2 with adhesive. For example, the holding plate 3 is a substrate including a Si substrate or a glass substrate with a thickness of about 0.5 mm to 3.0 mm. Moreover, by using the Si substrate or the glass substrate as the holding plate 3, the linear expansion coefficient becomes close to the substrate included in the head chip 2. Therefore, even if the holding plate 3 is attached to the head chip 2 by a method using heat such as using thermosetting adhesive as the adhesive, the bend between the holding plate 3 and the head chip 2 can be suppressed.

The shape of the holding plate 3 from a planar view is formed larger than the head chip 2 in both the front and back direction and the left and right direction. Specifically, both edges of the holding plate 3 in the left and right direction are largely outside the head chip 2.

An opening 31 is formed through the center of the holding plate 3 in a size which can surround all piezoelectric elements 24 aligned on the upper surface of the head chip 2 when the head chip 2 is attached to the holding plate 3.

The opening 31 is formed in a rectangular shape extending along the left and right direction. The inside of the opening 31 is formed in a size which is able to surround all of the piezoelectric elements 24 on the upper surface of the head chip 2, but does not reach the position of the ink supply openings 201 and 202 and the ink circulation openings 203 and 204 provided on both edges of the upper surface of the head chip 2. When the holding plate 3 is viewed from a planar view, each nozzle 211 formed in the nozzle plate 21 is positioned in the region in the front and back direction and the left and right direction in which the opening 31 is provided.

The bottom side of the opening 31 of the holding plate 3 is formed so that the space is larger than the upper side and the region of the opening 31 is formed to be a convex shape pointing up. The bottom side of the opening 31 is formed in a size so as to be able to include the piezoelectric element 24, the common supply flow path 25 provided in the front and back direction of the piezoelectric element 24 and the common circulation flow path 26 when the holding plate 3 is attached to the head chip 2.

Through holes 301, 302, 303, and 304 are formed near both edges of the holding plate 3 in the left and right direction in a size which can surround each one of the ink supply openings 201 and 202 and the ink circulation openings 203 and 204 provided on the upper surface of the head chip 2. The through holes 301, 302, 303, and 304 are used as ink flow paths to establish communication between the ink flow path member 5 and the head chip 2.

[Ink Flow Path Member]

The ink flow path member 5 is formed with synthesized resin such as poly phenylene sulfide resin (PPS) in a box like shape with the lower surface open. One ink flow path member 5 is provided in each edge of the upper surface of the holding plate 3 in the left and right direction.

Since the ink flow path members 5 provided to the left and the right have similar structures, the configuration of only the right ink flow path member 5 is described, and the description of the left ink flow path member 5 is omitted.

The ink flow path member 5 is provided with an ink supply flow path 501 which functions as a flow path to supply ink and an ink circulation flow path 504 which functions as a flow path to discharge ink.

Inside the ink flow path member 5, a filter 51 is provided for each of the ink supply flow path 501 and the ink circulation flow path 504 to remove impurities such as waste and air bubbles in the ink passing inside the ink flow path member 5. For example, metal mesh such as stainless steel, etc. is used as the filter 51, and this is attached to resin in the ink flow path member 5.

[Ink Circulation Mechanism]

Figure 6:
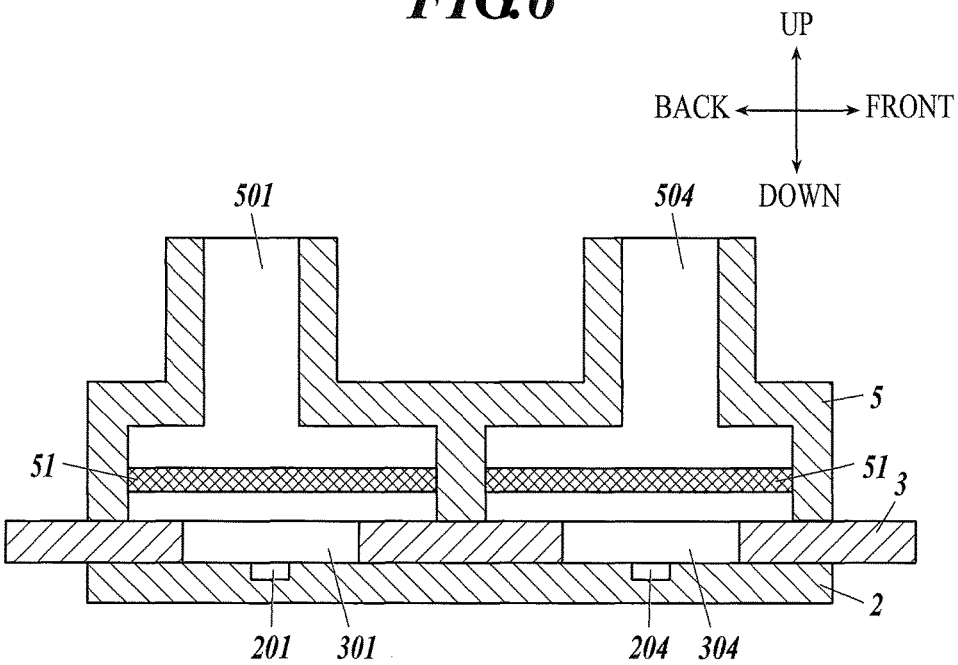
FIG. 6 is a cross-sectional diagram dividing a portion along line (VI)-(VI) in FIG. 2.

The ink circulation mechanism as the ink circulation member is described. In the ink flow path member 5, the ink supply flow path 501 is connected to a supply sub-tank 62 through an ink flow path 72, the ink is supplied inside the ink flow path member 5 from the supply sub-tank 62, and the ink is supplied in the head chip 2 through the through hole 301 and the ink supply opening 201 (see FIG. 6 and FIG. 7, etc.).

In the ink flow path member 5, the ink circulation flow path 504 is connected to a circulation sub-tank 63 through an ink flow path 73, and the ink discharged inside the ink flow path member 5 from the ink supply opening 201 of the head chip 2 through the through hole 304 can be discharged to the circulation sub-tank 63.

The supply sub-tank 62 and the circulation sub-tank 63 are provided in a position different in the up and down direction (gravity direction) with respect to a position reference surface in which the common supply flow path 25 and the common circulation flow path 26 are provided inside the head chip 2. With respect to the position reference surface, pressure P1 due to the hydraulic head difference from the supply sub-tank 62 and pressure P2 due to the hydraulic head difference from the circulation sub-tank 63 allows the ink inside the head chip 2 to circulate.

The supply sub-tank 62 is connected to the circulation sub-tank 63 by the ink flow path 74. The ink can be returned from the circulation sub-tank 63 to the supply sub-tank 62 using the pump 82.

The supply sub-tank 62 is connected to the main tank 61 by the ink flow path 71. The ink can be supplied from the main tank 61 to the supply sub-tank 62 using the pump 81.

Therefore, by suitably adjusting the hydraulic head difference of the supply sub-tank 62 and the circulation sub-tank 63, and the position of each sub-tank in the up and down direction (gravity direction), the pressure P1 and the pressure P2 are adjusted, and the ink inside the head chip 2 can be circulated at a suitable circulation flow rate.

[Filling Ink Inside the Head Chip]

A configuration similar to the above-described right ink flow path member 5 may be provided in the left side, and the left ink flow path member 5 can be configured as described below so that even pressure can be applied to the nozzles 211 and ink can be filled stably when the ink is filled inside the head chip 2.

In the left ink flow member 5, the ink supply flow path 502 and the ink circulation flow path 503 are connected with a tube through a valve (illustration not shown). When the ink is filled inside the head chip 2, the valve is opened, and pressure is applied from the ink supply flow path 501 of the right ink flow path member 5 toward the ink circulation flow path 504. With this, the ink can be filled in the common supply flow path 25 of the head chip 2.

Next, the valve between the ink supply flow path 502 and the ink circulation flow path 503 is closed, and pressure is further applied from the ink supply flow path 501, and the ink filled in the common supply flow path 25 is filled from each inlet 232, to near each nozzle 211. Further, the ink can be flown from each circulation flow path 213, to the common circulation flow path 26.

Viscosity resistance of the circulation flow path 213 is made sufficiently lower than the viscosity resistance of the nozzle 211. Therefore, the ink can be filled in the nozzle without breaking the meniscus of the nozzle 211 and throwing away the ink.

After the ink is filled, the ink can be circulated by suitably adjusting the above-described pressure P1 and P2 so that the pressure near the nozzle 211 and the speed of the circulation flow rate becomes a predetermined value.

[Ink Ejecting Properties]

As described above, the ink can be ejected from the nozzle 211 by applying pressure to the pressure chamber 231 with the piezoelectric element 24. Here, the ink is supplied to the pressure chamber 231 from the inlet 232, and the ink circulation flow path 213 is provided near the nozzle 211.

Therefore, the ink ejecting properties can be determined by the impedance Zn of the nozzle 211, the impedance Zi of the inlet 232, and the impedance Zc of the circulation flow path 213.

The impedances Z are values which can be determined by the viscosity resistance R and the inertance M of the flow path. As described below, the value can be calculated as an electric equivalent circuit constant. With the electric circuit simulator, the resonance frequency of the pressure chamber, and ejecting properties such as liquid drop speed, ejecting negative pressure, and driving voltage can be calculated.

Specifically, in the inlet 232 and the circulation flow path 213, when the shape of the flow path is a rectangular solid, and when a flow path width (front and back direction) is w (μm), a flow path height (up and down direction) is h (μm), a flow path length (left and right direction) is l (μm), an ink fluid viscosity is η (Pa/s), an ink density is ρ (kg/m$^3$), and a driving pulse frequency (an inverse of driving pulse length) is f (Hz), the following calculations are possible, the inertance $M=\rho l/hw$, the viscosity resistance $R=8\eta l(h+w)^2/(hw)^3$, the impedance $Z=(R^2+2\pi fM^2)^{1/2}$.

In the nozzle 211, when the shape of the nozzle 211 is a cylinder, and when a flow path diameter is d (μm), a flow path height (up and down direction) is l (μm), an ink fluid viscosity is η (Pa/s), an ink density is ρ (kg/m$^3$), and a driving pulse frequency (an inverse of driving pulse length) is f (Hz), the following calculations are possible, the inertance $M=4\rho l/\pi d^4$, the viscosity resistance $R=128\eta l/\pi d^4$, the impedance $Z=(R^2+2\pi fM^2)^{1/2}$.

The rectangular solid shape and the cylinder shape are described above. Alternatively, when other shapes are employed, such as a tapered shape, calculations are possible by segmenting the tapered shape as the rectangular solid shape in the length direction and integrating.

A setting value of impedance Zc of the circulation flow path 213 according to the present invention is described using experimental values shown in FIG. 8A, FIG. 8B, FIG. 9A and FIG. 9B.

Figure 8A:
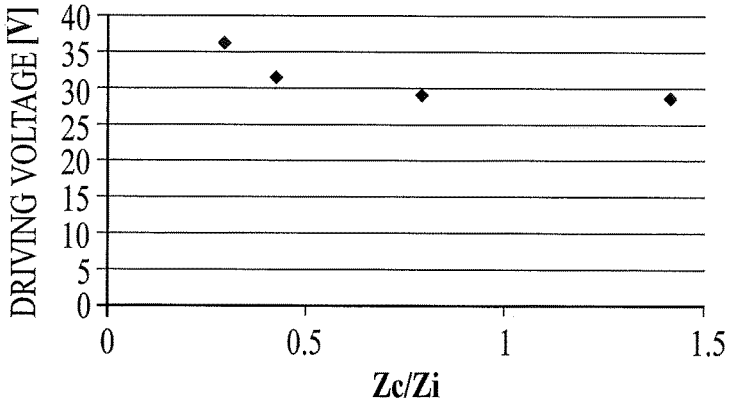
FIG. 8A is a graph showing a relation between a ratio (Zc/Zi) of an impedance of a circulation flow path and an inlet and a driving voltage (V) of an actuator when ejecting liquid drop amount of an ink liquid drop is 3.5 pL and ejecting speed is 7 m/s.
Figure 8B:
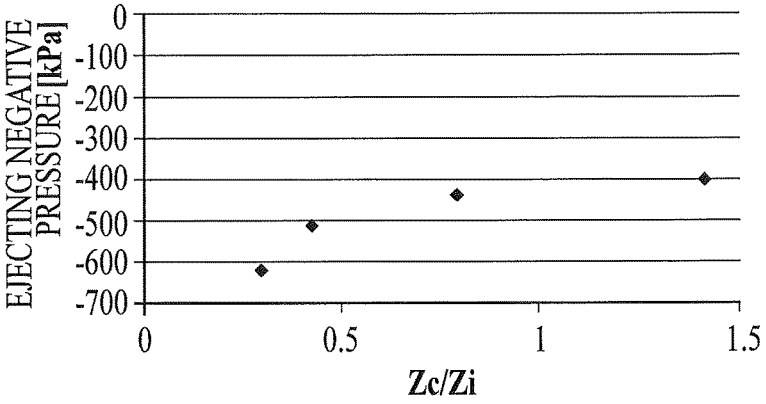
FIG. 8B is a graph showing a relation between the ratio (Zc/Zi) of the impedance of the circulation flow path and the inlet and ejecting negative pressure (kPa) when the ejecting liquid drop amount of the ink liquid drop is 3.5 pL and the ejecting speed is 7 m/s.

FIG. 8A and FIG. 8B show a state when the ink liquid drop is ejected with the ejecting liquid drop amount as 3.5 pL and the ejecting speed as 7 m/s. FIG. 8A shows the relation of the values when the ratio (Zc/Zi) between the impedance Zc of the circulation flow path 213 and the impedance Zi of the inlet 232 is shown in the horizontal axis and the driving voltage (V) of the piezoelectric element 24 is shown in the vertical axis. FIG. 8B shows the relation of the values when the ratio (Zc/Zi) between the impedance Zc of the circulation flow path 213 and the impedance Zi of the inlet 232 is shown in the horizontal axis and the ink ejecting negative pressure (kPa) is shown in the vertical axis. Here, the ejecting negative pressure is pressure near the nozzle caused at the time of ejecting, and when this value becomes too low, air bubbles are generated by cavitation. Therefore, it is necessary to maintain the ejecting negative pressure to a predetermined value or more.

Figure 9A:
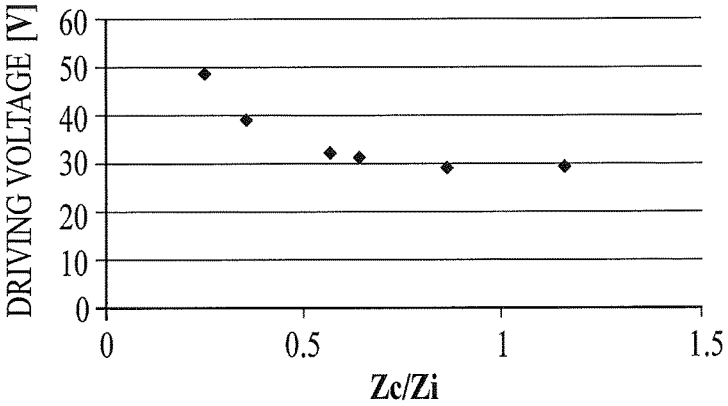
FIG. 9A is a graph showing a relation between the ratio (Zc/Zi) of the impedance of the circulation flow path and the inlet and the driving voltage (V) of the actuator when the ejecting liquid drop amount of the ink liquid drop is 1.0 pL and the ejecting speed is 7 m/s.
Figure 9B:
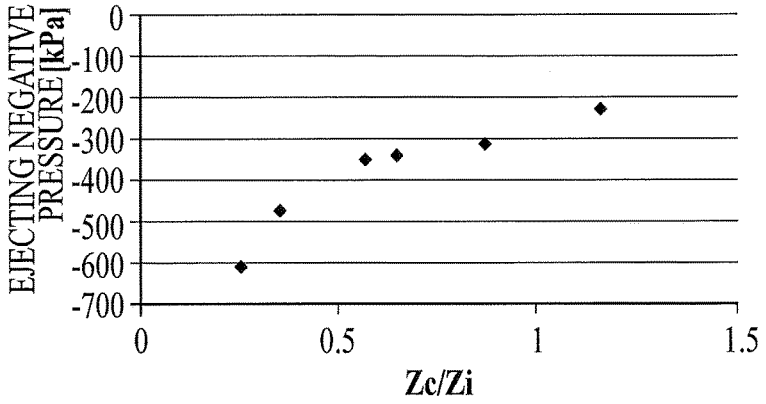
FIG. 9B is a graph showing a relation between the ratio (Zc/Zi) of the impedance of the circulation flow path and the inlet and the ejecting negative pressure (kPa) when the ejecting liquid drop amount of the ink liquid drop is 1.0 pL and the ejecting speed is 7 m/s.

FIG. 9A and FIG. 9B show a state when the ink liquid drop is ejected with the ejecting liquid drop amount as 1.0 pL and the ejecting speed as 7 m/s. Similar to FIG. 8A and FIG. 8B, FIG. 9A shows the relation of the values when the impedance ratio (Zc/Zi) is shown in the horizontal axis and the driving voltage (V) of the piezoelectric element 24 is shown in the vertical axis, and FIG. 9B shows the relation of the values when the impedance ratio (Zc/Zi) is shown in the horizontal axis and the ink ejecting negative pressure (kPa) is shown in the vertical axis.

As shown in FIG. 8A, FIG. 8B, FIG. 9A, and FIG. 9B, regardless of whether the ejecting liquid drop amount is 3.5 pL (FIG. 8A and FIG. 8B) or the ejecting liquid drop amount is 1.0 pL (FIG. 9A and FIG. 9B), the driving voltage (V) of the piezoelectric element 24 is almost constant when Zc/Zi is 0.5 or more, and the inclination of the increase of the ejecting negative pressure (kPa) becomes moderate at 0.5 or more.

As described above, when the ratio (Zc/Zi) between the impedance Zc of the circulation flow path 213 and the impedance Zi of the inlet 232 is 0.5 or more, the rise of the driving voltage (V) of the piezoelectric element 24 and the ejecting negative pressure can be suppressed. With this, the air bubbles being generated can be suppressed. Therefore, it can be said that the ink ejecting performance is high. The ratio (Zc/Zi) of the impedance Zi can be set without upper limits from the view point of ejecting performance. However, if the ratio (Zc/Zi) of the impedance Zi rises, the viscosity resistance also rises at the same time. Therefore, the value is set to a range of 0.5 or higher and lower than the nozzle viscosity resistance.

When the viscosity resistance Rc of the circulation flow path 213 becomes larger than the viscosity resistance Rn of the nozzle 211, the meniscus of the nozzle 211 may break when the ink is filled or the ink is circulated. Therefore, the viscosity resistance Rc of the circulation flow path 213 needs to be made smaller than the viscosity resistance Rn of the nozzle 211.

According to the configuration of the present invention, as a result of electric circuit simulation, the ink circulation flow rate can be made equal to or faster than the point of maximum ejecting (ejecting liquid drop amount (pL) x ejecting frequency (Hz)), and foreign substances such as air bubbles can be effectively removed. The electric circuit simulation is obtained from the pressure of in and out and replacing the flow path with the electric equivalence circuit similar to the above-described ejecting performance.

Preferably, in order to make the circulation flow rate faster, the total viscosity resistance Rs (Rs=Ri+Rc) of the viscosity resistance Ri of the inlet 232 and the viscosity resistance Rc of the circulation flow path 213 can be made smaller than the viscosity resistance Rn of the nozzle 211.

The value of the impedance Zc of the circulation flow path 213 and the value of the impedance Zi of the inlet 232 can be set suitably. If the impedance Zc of the circulation flow path 213 is set to a large value, the pressure loss to the circulation flow path 213 becomes small. Therefore, the ejecting performance becomes closer to a configuration which does not include the circulation flow path 213.

[Modification]

The modification of the head chip 2 provided with the circulation flow path 213 is described with reference to FIG. 10 and FIG. 11.

Figure 10:
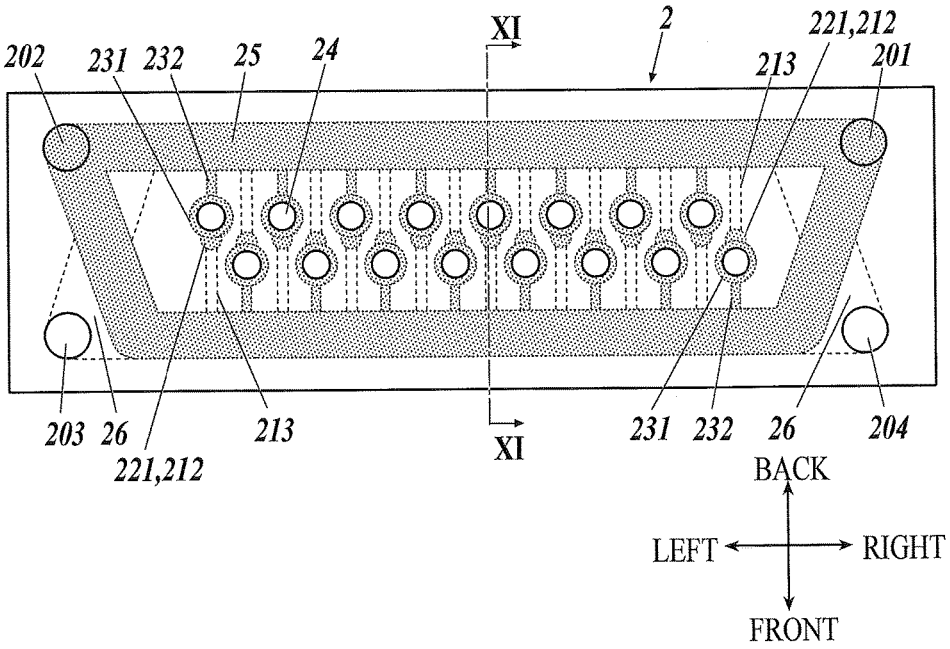
FIG. 10 is a planar diagram of a head chip according to a modification.

For the purpose of ease of description, FIG. 10 shows the configuration inside the head chip 2 with broken lines. The ink flow path from the common supply flow path 25 to the communicating hole 221, . . . is shown with dots.

The description of the configuration similar to the above-described embodiment is omitted.

On the upper surface, the head chip 2 includes a piezoelectric element 24 provided aligned in two lines so as to be in a staggered arrangement along a left and right direction, ink supply openings 201 and 202 which supply ink from the ink flow path member 5 to inside the head chip 2, ink circulation openings 203 and 204 which discharge ink from inside the head chip 2 to the ink flow path member 5, and the like (FIG. 10).

Figure 11:
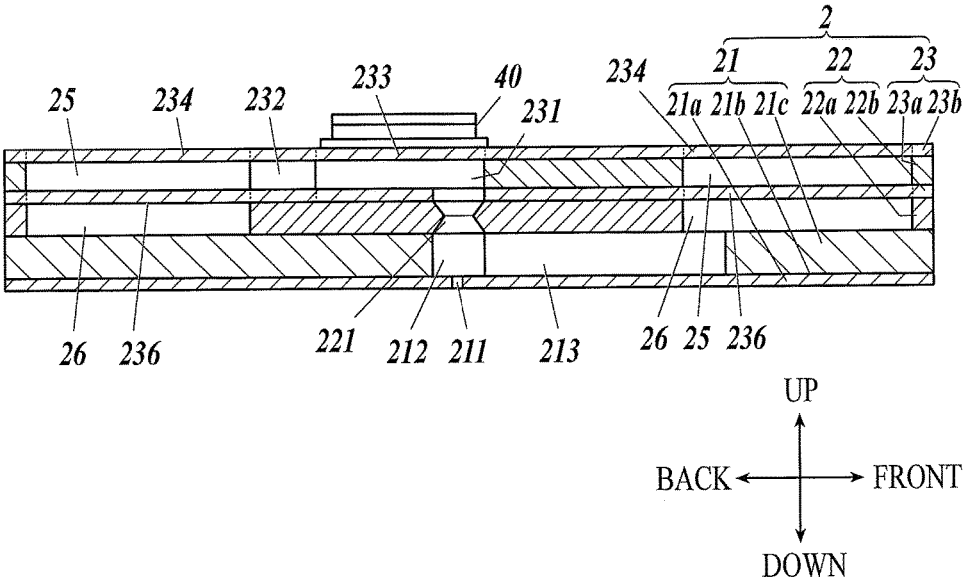
FIG. 11 is a cross-sectional diagram dividing a portion along line (XI)-(XI) in FIG. 10.

Inside the head chip 2, the following three substrates are layered as one from the bottom in order, the nozzle plate 21, the intermediate plate 22, and the body plate 23 (FIG. 11). The pressure chamber 231 is formed to correspond to each piezoelectric element 244 on the pressure chamber layer 23*a* in the lower side of the piezoelectric element 24 provided aligned in two lines so as to be in the staggered arrangement.

The common supply flow path 25 is formed only on the pressure chamber layer 23*a* of the body plate 23. The common supply flow path 25 is provided in two lines along the left and right direction near the front side and the back side of the head chip 2 with the position in which the piezoelectric elements 24 are aligned in between.

The vibrating layer 23*b* which can be slightly elastically deformed is formed on the upper surface of the pressure chamber layer 23*a*. The vibrating layer 23*b* on the upper surface of the common supply flow path 25 functions as the damper 234.

The common circulation flow path 26 is formed on only the intermediate plate layer 22*a* of the intermediate plate 22 so as to be positioned on the lower side of the body plate 23 in which the common supply flow path 25 is formed.

The vibrating layer 22*b* which can be slightly elastically deformed is formed on the upper surface of the intermediate plate layer 22*a* of the intermediate plate 22, and the vibrating layer 22*b* on the upper surface of the common circulation flow path 26 functions as the damper 236.

Regarding the ink circulation flow path, first the ink is supplied from the ink supply openings 201 and 202 to the common supply flow path 25 formed aligned near the front side and the back side of the head chip 2. Next, the ink is supplied to each pressure chamber 231, . . . provided on the lower side of the piezoelectric element 24 aligned in a staggered state from the common supply flow path 25 on the front side or the back side, which has the short distance, through the inlets 232, . . . . Next, the ink is flown in the following order, the communicating holes 221, . . . , the large size portion 212, . . . , and the circulation flow path 213, . . . . Next, the ink from each circulation flow path 213, . . . meets the common circulation flow path 26 on the front side or the back side. The ink is discharged from the ink circulation openings 203 and 204, and the ink flows through the ink circulation flow path 504 and returns to the circulation sub-tank 63 (see FIG. 7, FIG. 10, and FIG. 11).

[Technical Effects of the Present Invention]

As described above, the viscosity resistance Rc of the circulation flow path 213 is made smaller than the viscosity resistance Rn of the nozzle 211, and the impedance Zc of the circulation flow path 213 is made 0.5 times or more than the impedance Zi of the inlet. With this, as for the inkjet head 1 of the present invention, the reduction of the ejecting performance of ink can be suppressed to a minimum and the air bubbles, etc. near the nozzle can be effectively discharged without applying a burden to the apparatus.

Specifically, when the circulation flow path 213 is formed, the pressure escapes to the circulation flow path 213. Therefore, the pressure is easily lost. However, according to the configuration of the present invention, the pressure loss can be suppressed to a minimum, and the mechanism can be driven with low voltage.

Since the ejecting negative pressure is suppressed, the air bubbles being generated can be suppressed.

The ink circulation flow rate can be made the same as or faster than the point of maximum ejecting (ejecting liquid drop amount (pL)×ejecting frequency (Hz)). With this, the foreign substances such as air bubbles can be efficiently removed.

Since the circulation flow path 213 is formed near the nozzle 211, the foreign substances such as air bubbles near the nozzle can be removed.

Since the inlet 232 includes a narrow portion with the flow path narrower than the pressure chamber 231, the pressure of the pressure chamber 231 can be effectively raised.

The total viscosity resistance of the inlet 232 and the circulation flow path 213 is made smaller than the viscosity resistance of the nozzle 211. With this, the circulation flow rate can be made faster.

The nozzle communicating path (large size portion 212) which has a larger diameter than the nozzle 211 which communicates ink from the pressure chamber 231 and the circulation flow path 213 are formed in the nozzle supporting layer 21*c* layered on the upper surface of the nozzle layer 21*a* in which the nozzle 211 is formed. With this, the circulation flow path 213 can be formed directly above the nozzle. Therefore, the air bubbles, etc. near the nozzle can be effectively removed and the clogging of the nozzle 211 can be prevented.

The binding layer 21*b* with a lower etching rate than the nozzle supporting layer 21*c* is provided between the nozzle layer 21*a* and the nozzle supporting layer 21*c*. The nozzle supporting layer 21*c* includes a space facing the binding layer 21*b* or the nozzle layer 21*a*. The circulation flow path 213 is formed by this space. Therefore, the circulation flow path 213 can be made while reducing the error in manufacturing as much as possible.

The common circulation flow path 26 connected to the circulation flow path 213 corresponding to each of the plurality of nozzles 211 is formed in at least one of the body plate (body layer) 23 and the intermediate plate (intermediate layer) 22. With this, the common circulation flow path 26 can be provided stably, and the manufacturing can be performed reducing the error in manufacturing as much as possible.

The inkjet head 1 of the present invention can be used in an inkjet recording device 100 by separately providing an ink circulator to cause a circulation flow (ink circulation mechanism).

[Others]

The embodiments disclosed in the present application are merely examples in all points and do not limit the present invention. The scope of the present invention is shown in the following claims and is not limited by the above detailed description. The scope of the present invention includes equivalents and all modifications within the scope of the present invention.

For example, the ink flow path member 5 of the present invention including the ink supply flow path and the ink circulation flow path is provided so that there is one in each side in the left and right direction. Alternatively, the configuration can be suitably changed as long as the ink can be circulated, and one can be provided in one side. Alternatively, for example, only the ink supply flow path may be provided in the left ink flow path member 5 and only the ink circulation flow path may be provided in the right ink flow path member 5.

As the ink circulation method to cause the circulation flow, the method of control by using the pressure due to hydraulic head difference is described. Alternatively, this can be suitably changed to any configuration which can generate the circulation flow as described in the present invention.

The inkjet head 1 is a configuration which ejects the liquid drop such as ink using the piezoelectric element. Alternatively, any mechanism which can discharge liquid drops can be employed, and for example, thermal units (thermal electric conversion elements) can be used.

Further, the scope of the present invention is not limited to the above, and various modifications and changes in design are possible without leaving the scope of the present invention.

INDUSTRIAL APPLICABILITY

The present invention can be used in an inkjet head and an inkjet recording device including an inkjet head and an ink circulator to generate a circulation flow.

DESCRIPTION OF REFERENCE NUMERALS

1 inkjet head
21 nozzle plate
21*a* nozzle layer
21*b* binding layer
21*c* nozzle supporting layer
211 nozzle
212 large size portion (nozzle communicating path)
213 circulation flow path
22 intermediate plate (intermediate layer)
221 communicating hole (intermediate communicating path)
23 body plate (body layer)
231 pressure chamber
232 inlet
24 piezoelectric element (pressure generating unit)
25 common supply flow path
26 common circulation flow path
100 inkjet recording device

The invention claimed is:

1. An inkjet head comprising:
a plurality of nozzles which eject ink;
a pressure chamber which is individually communicated with each nozzle and which is filled with ink inside;
a pressure generator which is a driving source to eject ink by applying pressure to the pressure chamber;
an inlet which includes a narrow portion with a flow path narrower than the pressure chamber and which supplies ink to the pressure chamber; and
a circulation flow path which is able to discharge ink in the pressure chamber from near the nozzle,
wherein, viscosity resistance of the circulation flow path is smaller than viscosity resistance of the nozzle, and impedance of the circulation flow path is equal to or more than 0.5 times of impedance of the inlet.

2. The inkjet head of claim 1, wherein, a total viscosity resistance of the inlet and the circulation flow path is smaller than a viscosity resistance of the nozzle.

3. The inkjet head of claim 1, further comprising,
a nozzle layer in which the plurality of nozzles are formed; and
a nozzle supporting layer which is layered on an upper surface of the nozzle layer and in which a nozzle communicating path with a diameter larger than the nozzle communicating ink from the pressure chamber and the circulation flow path are formed.

4. The inkjet head of claim 3, further comprising a nozzle plate including the nozzle layer and the nozzle supporting layer.

5. The inkjet head of claim 4, wherein,
the nozzle plate includes a binding layer with an etching rate lower than the nozzle supporting layer between the nozzle layer and the nozzle supporting layer,
the nozzle supporting layer includes a space facing the binding layer or the nozzle layer, and
the circulation flow path is formed by the space.

6. The inkjet head of claim 5, wherein, the binding layer is made from a $SiO_2$ substrate.

7. The inkjet head of claim 3, wherein the nozzle layer is made from a Si substrate.

8. The inkjet head of claim 3, wherein the nozzle supporting layer is made from a Si substrate.

9. The inkjet head of claim 3, further comprising,
a body layer in which the pressure chamber is formed, and
an intermediate layer in which an intermediate communicating path communicating the pressure chamber and the nozzle communicating path is formed,
wherein, a common circulation flow path is formed in at least one of the body layer and the intermediate layer, the common circulation flow path connected to the circulation flow path corresponding to each of the plurality of nozzles.

10. An inkjet recording device comprising an inkjet head of claim 1.

11. The inkjet recording device of claim 10, further comprising an ink circulator which generates a circulation flow from the inlet to the pressure chamber and the circulation flow path.

12. The inkjet recording device of claim 10, further comprising a circulation sub-tank in which ink discharged from the circulation flow path is accumulated.

13. The inkjet recording device of claim 12, further comprising a supply sub-tank in which ink supplied to the inlet is accumulated.

14. The inkjet recording device of claim 13, wherein, the circulation sub-tank and the supply sub-tank are connected by an ink flow path.

* * * * *